US005427384A

United States Patent [19]

Saunders

[11] Patent Number: 5,427,384

[45] Date of Patent: Jun. 27, 1995

[54] ARROW BRAKE FOR ARCHERY USE

[75] Inventor: Charles A. Saunders, Columbus, Nebr.

[73] Assignee: Saunders Archery Company, Columbus, Nebr.

[21] Appl. No.: 354,966

[22] Filed: Dec. 14, 1994

[51] Int. Cl.[6] ..... F42B 6/04

[52] U.S. Cl. ..... 273/416

[58] Field of Search ..... 273/416, 419–422

[56] References Cited

U.S. PATENT DOCUMENTS

| | | | |
|---|---|---|---|
| 3,945,642 | 3/1976 | Henthorn, Jr. | 273/421 X |
| 4,254,958 | 3/1981 | Bateman, III | 273/421 |
| 4,380,340 | 4/1983 | Simo | 273/416 |
| 4,905,397 | 3/1990 | Juelg, Jr. | 273/416 X |
| 5,022,658 | 6/1991 | Burkhart | 273/416 |

OTHER PUBLICATIONS

1986 Saunders Successories Catalog, p. 9, Jul. 1986; Arrow Penetration Limiter.

*Primary Examiner*—Paul E. Shapiro
*Attorney, Agent, or Firm*—Michael G. Berkman

[57] ABSTRACT

An arrow brake for attachment to the shaft of the archery arrow. The brake impedes and effectively prevents the released arrow from passing entirely through the body of a target impinged by the arrow. The brake includes a relatively thin and flexible ring for sleeved frictional engagement on the arrow shaft. Attached to and extending radially of and forwardly of the ring are annularly spaced wedge-shaped probes. Engagement of the probes within the body of the target causes the probes to pivot arcuately, upwardly and rearwardly, to define a segmented wall generally normal to the arrow shaft to impede travel of the arrow shaft through the target body. Stops integrally formed with the probes pivot with the latter and come to abut the surface of the arrow shaft rearwardly of the ring thus limiting further arcuate displacement of the probe elements. In a preferred embodiment of the invention the arrow-shaft-engaging inner annular surface of the ring is cylindrical. Distortion of the ring in response to bending forces applied thereto as the probes are arcuately pivoted causes the ring to twist and distort with the effect of reducing the effective inner diameter of the ring. Gripping of the ring on the arrow shaft is thereby significantly enhanced, and rearward sliding of the ring on the arrow shaft is deterred.

4 Claims, 1 Drawing Sheet

ARROW BRAKE FOR ARCHERY USE

FIELD OF THE INVENTION, AND BACKGROUND

The present invention relates to an archery accessory to be mounted on the shaft of an arrow. More particularly, the invention relates to an arrow brake for deterring a forcibly released arrow from passing entirely through the body of a target impinged by the arrow. The brake serves to arrest arrow flight by the arrow. Frictional braking forces are enhanced upon impact. The brake serves to arrest arrow flight after the arrow has penetrated the target.

It will be appreciated that in the sport of bow hunting, recovery of a trophy struck by an archer's arrow is facilitated and enhanced if the arrow remains embedded in the body of the target rather than passing through. At the same time recovery of the arrow itself is materially aided.

Arrow brakes are known in the art. However, some of these are heavier than desirable and interfere with true flight of the released arrow and with accuracy. Other arrow brakes prevent or impede true arrow flight because of imbalance and cause the arrow to veer off target. Arrow brakes which modify arrow flight to produce unpredictable variations and inconsistencies markedly and adversely affect the archer's accuracy and effectiveness. Still other arrow brakes present unduly broad surfaces, causing excessive air resistance forces which reduce the velocity of the arrow in flight and also the functional efficacy.

Many of the arrow brakes presently marketed fail securely and positively to resist sliding displacement along the length of the arrow shaft.

It is, therefore, a principal aim of the present invention to provide an arrow brake which is simple and readily positionable on an arrow shaft, which is effective to brake and stop arrow travel through a target, and which avoids many of the deficiencies and shortcomings of prior art devices.

SUMMARY OF THE INVENTION

In accordance with the present invention there is provided an arrow brake which is skeletal in structure, exceedingly strong, and which is extremely light in weight. The device presents little impedence during flight of the arrow and contributes only negligibly to the overall weight of the propelled arrow.

It is a feature of the arrow of the invention that it is of a unitary and highly durable structure molded of a semi-rigid, deformable yet resilient plastics material, including a slim. arrowshaft-engaging ring frictionally mounted on the arrow shaft.

A related feature of the arrow brake is that the arrow-shaft-engaging ring is slidable along for convenient placement selectively along the lineal expanse of the arrow shaft.

An important structural feature of the arrow brake of the invention is that there are provided a plurality of ring-mounted, annularly-spaced, wedge-shaped probes extending radially of and forwardly of the mounting ring, for positively engaging within the target body.

A related and cooperating structural feature of the brake assembly of the invention is a series of mechanical stops also integrally formed with the ring but projecting rearwardly thereof and of the forwardly projecting probes.

It is an important feature of the invention that upon entry into the body of the target the forwardly extending probes pivot to form a segmented wall deterring uncontrolled advance of the arrow shaft through the body of the invaded target.

A related feature of the invention is that engagement of the probes within the body of the target causes the probes to pivot arcuately and upwardly and rearwardly while the stops pivot or swing downwardly to abut and positively to stress and bear upon the surface of the arrow shaft rearwardly of the brake mounting ring.

An important feature of the invention is that in a preferred embodiment the shaft-mounting ring of the arrow brake is like an o-ring but is cylindrical on its inner face engaging the arrow shaft. The effect is that distortion of the ring in response to twisting or bending forces applied thereto as the probes are arcuately pivoted upwardly and rearwardly causes the ring to deform and roll somewhat with the effect of reducing an effective inner diameter of the ring itself. Gripping forces of the ring impressed on the arrow shaft are significantly increased. Sliding of the arrow brake rearwardly along the arrow shaft is effectively deterred.

Other and further objects, features and advantages of the invention will be evident upon a reading of the following description considered in conjunction with the drawings.

For example, the arrow brake of the invention is characterized in that it poses little resistance to sliding displacement forwardly toward the arrow point or broadhead, while offering significant resistance against movement in the opposite lineal direction upon engagement with the body of an impinged target.

DETAILED DESCRIPTION OF ILLUSTRATED EMBODIMENT

The aims and objects of the invention are accomplished by providing, in an arrow brake for archery use, a unitary assembly of strong yet resiliently deformable plastics composition. The assembly defines an arrow shaft mountable arrow brake for slowing and deterring the passage of an arrow shaft into the body of a target forcibly invaded by the arrow.

In the embodiment of the invention shown an annular array of arcuately spaced wedge-like probes are hingedly mounted on a supporting ring, the latter frictionally embracing the circumscribed arrow shaft. As the wedge-like probes physically engage the body of the target, they are pivoted about their zones of attachment to the supporting ring and rearwardly directed sections of each pivotal probe comes to butt against the arrow shaft. At the same time, the assembly mounting ring is forcibly distorted.

An important feature of the invention is that the mounting ring of the brake assembly is so configured that upon distortion as effected during pivotal displacement of the probe elements, the inner diameter of the ring is effectively reduced thereby enhancing the gripping of the ring onto the embraced arrow shaft. In the specific embodiment of the invention depicted, the ring is formed with a generally cylindrical inner wall face which contiguously abuts and grips an encircled outer wall surface of the arrow shaft on which the brake assembly is frictionally sleeved. Such distortion of the ring as occurs when other wedge-like elements pivot is effective to displace the "flattened" zone of the ring. The result is a reduction in the functional inner diameter of the ring. The frictional force with which the arrow brake assembly is held in place on the arrow shaft is thus significantly enhanced. The change in diameter is shown schematically in FIG. 6 of the drawings, and in FIG. 5.

Figure 2:
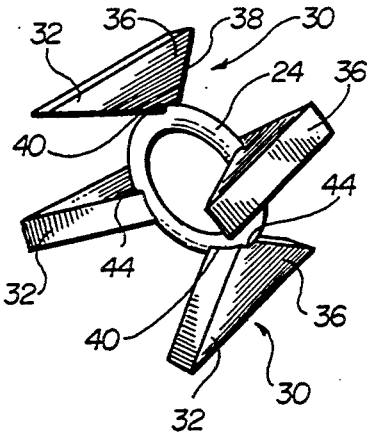
FIG. 2 is an enlarged, perspective view of an arrow brake according to the present invention and showing the wedge-like elements secured to the periphery of the mounting ring and spaced therearound.
Figure 3:
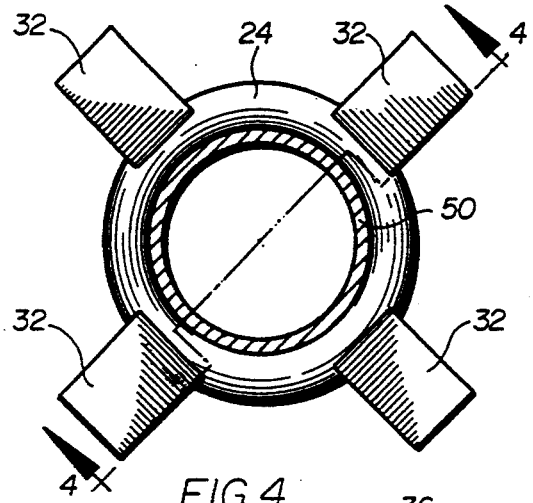
FIG. 3 is a cross-sectional view taken substantially on the lines 3—3 of FIG. 1 and showing the wedge-like elements supported on the periphery of the ring-like mount.

Referring now more particularly to the drawings, for purposes of disclosure and not in any limiting sense, a preferred embodiment of the arrow brake of the invention is shown as a unitary assembly 20. As depicted in FIG. 2 of the drawings the brake or brake assembly 20 comprises a ring 24 which carries a circumferentially-distributed and an annularly-spaced array of pivotally-secured, generally wedge-shaped probes and stop elements 30.

Figure 1:
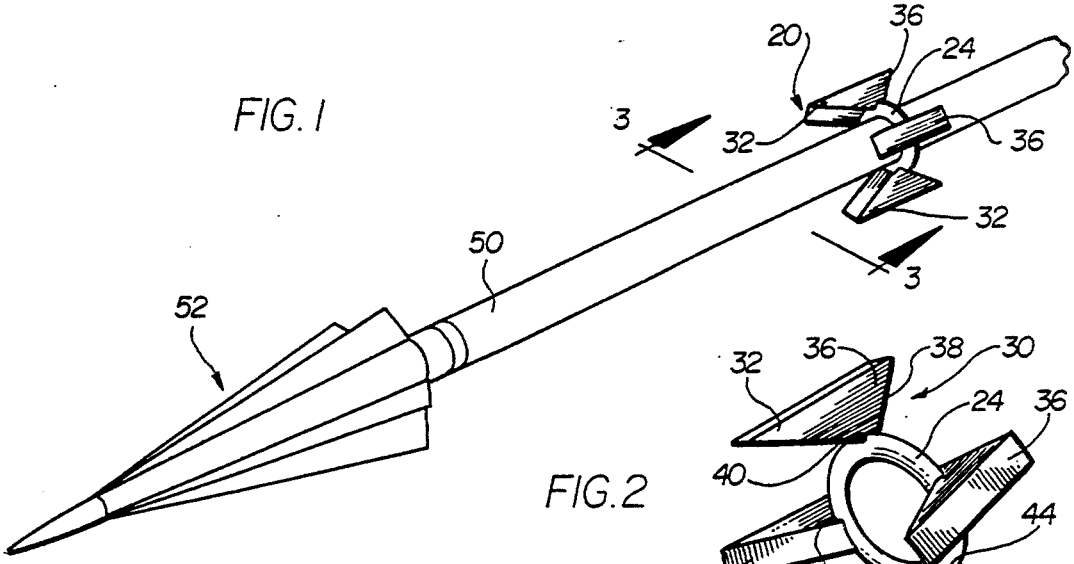
FIG. 1 is a perspective view of a forward lineal section of an arrow to the shaft of which a brake embodying the features of the present invention is attached.
Figure 4:
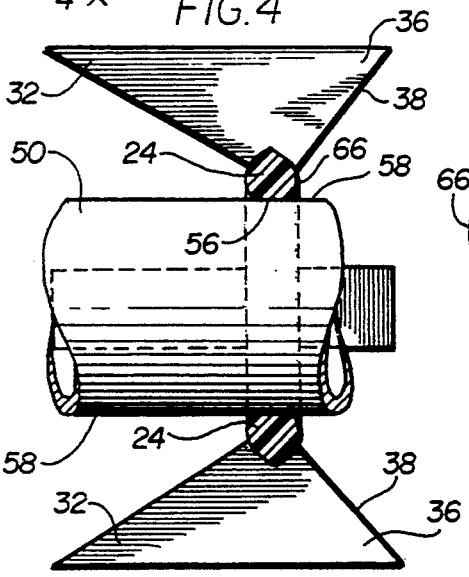
FIG. 4 is an enlarged fragmentary view taken substantially on the lines 4—4 of FIG. 3 and indicating schematically a preferred cross-sectional configuration of the arrow-shaft-engaging ring of the brake assembly.
Figure 5:
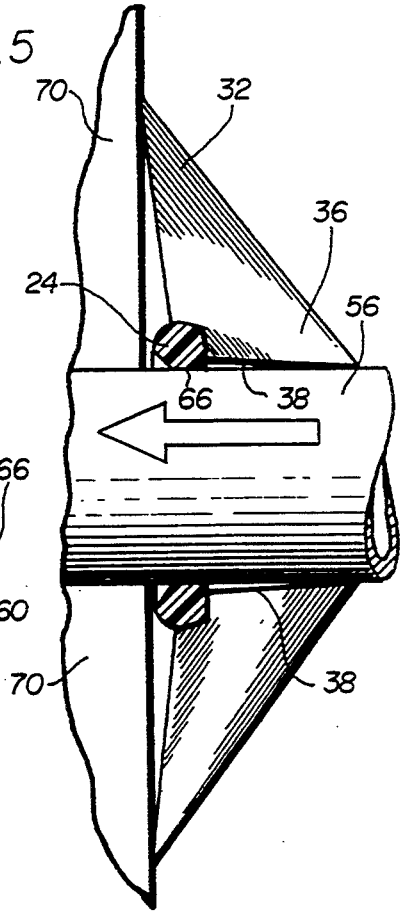
FIG. 5 is an enlarged, fragmentary, cross-sectional view indicating schematically the configuration assumed by the ring and by the ring-mounted wedge elements of the brake when the wedges are forcibly pivoted upon engagement with an impinged target.

As seen in FIGS. 1, 2, and 4 of the stop elements 30 each define a forwardly-directed acutely-angled pointed probe 32. The latter is integral with a rearwardly-presented less-sharpened wedge configuration 36 presenting a rearwardly directed abutment face 38. At their angled juncture 40, the opposed wedge-like elements 32 and 36 of each stop element 30 are joined to the outer periphery 44 of the ring 24, as shown in FIGS. 2, 4 and 5. Preferably, the ring 24 and the ring-mounted stop elements are molded as a unitary assembly of a high-strength, firm yet resilient plastics composition. FIG. 1 shows the brake assembly 20 sleevedly mounted in place on the shaft 50 of an arrow somewhat rearwardly of the point 52.

Figure 6:
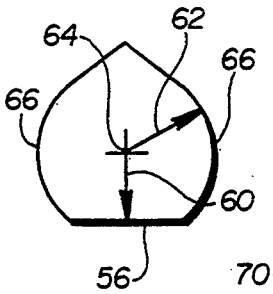
FIG. 6 is an enlarged, transverse, cross-sectional view of the mounting ring of the brake assembly showing the "flattened" cylindrical inner annular surface for contiguously engaging the shaft of the arrow.

The operation of the brake of the invention will be evident upon consideration of FIGS. 1, 4, 5, and 6. Referring first, however, to FIG. 6, there is shown the transverse cross-sectional configuration of the ring 24 which sleevedly encircles and frictionally engages the arrow shaft 50. Attention is directed, in particular, to the fact that the ring includes a cylindrical surface 56 and is not rounded as is a conventional O-ring in that zone which initially engages the surface 58 of the arrow shaft 50, as shown in FIG. 4.

It will be appreciated, upon consideration of the radii 60 and 62 from the center 64 to the outer or bounding surfaces, 66, and 56, indicated schematically in FIG. 6, that they differ. The distance from the center 64 to the surface 50 is less than to the surface 66. The configurational attitude of the ring 24 and the ring-carried stop elements as they appear in an "at ready" mode as exists in FIG. 1 is shown more definitively in FIG. 4. The front probes 32 of the wedges 30 project forwardly, and the outer surface 58 of the arrow shaft is engaged by the cylindrical or "flattened" portion 56 of the mounting ring 24.

Referring now to FIG. 5, when the arrow point 52 (See FIG. 1) impinges against and invades the target body 70, the leading probe ends 32 of the stop elements 30 engage and bear against the target body causing the probe elements 30 engage and bear against the target body causing the probe elements 30 to pivot at their attachment to the ring 24. At its extreme rotational displacement (FIG. 5). the abutment face 38 of the stop elements come to bear against the outer surface 56 of the arrow shaft 50, as shown in FIG. 5.

Concurrently, rotational torque forces are applied against the element-supporting ring 24, As a result the ring 24 is torqued, twisted, deformed and displaced rotationally. The round portion 66 of the ring 24 is forcibly brought in contact with to bear against the arrow shaft 50. Since the effective inside diameter of the ring 24 is less in the rounded sector 66, less radial space is afforded the inserted arrow shaft 50. The ring 24 is "tighter" on the arrow shaft 50. Accordingly, frictional forces applied by the ring 24 against the arrow shaft 50 are materially increased. The braking forces deterring movement of the brake assembly 20 along the arrow shaft 50 are significantly enhanced (FIG. 5).

What is claimed is:

1. An arrow brake for attachment to the shaft of an archery arrow for effectively impeding passage of the shaft through the body of a target forcibly invaded by the arrow, said brake comprising ring means for frictionally and sleevedly grippingly engaging the shaft of an arrow upon which said ring means is slideably positioned and supported, an annularly-arranged array of pivotally-supported probe means disposed to extend about said ring means for physically engaging within the body of a target for arresting flight-impelled passage of an arrow shaft through the body of the target, hinge-like attachment means for securing said probe means to said ring means at annularly spaced arcuate increments thereabout for supporting said probe means to extend in a circumambient zone displaced radially outwardly from said ring means, each of said probe means including forwardly-directed, wedge-like, tapered point means for engaging and penetrating the body of a target upon flight-induced entry of the shaft of an arrow into the target body, each of said probe means including rearwardly-directed, pivotally-supported stop means integrally formed with said point means for abuttingly engaging the arrow shaft rearwardly of said point means upon pivotal displacement of said probe means during penetrating invasion of the arrow shaft into the body of the target.

2. An arrow brake as set forth in claim 1 wherein said ring means includes integrally formed means for automatically reducing an inner diameter dimension of said ring means so as to increase frictional forces between said ring means and the arrow shaft when said probe means carried by said ring means are forcibly pivoted in response to stressing forces applied to said probe means when the arrow shaft on which said ring means is supported effects forcible penetration into the body of a target.

3. An arrow brake as set forth in claim 2 wherein said ring means is formed with annular, generally-cylindrical wall sector means at a radially-inward, annular zone of said ring means for contiguously abutting an outer cylindrical surface of an arrow shaft upon which said ring means is frictionally sleeved.

4. An arrow brake as set forth in claim 1 wherein said ring means includes means responsive to distortional forces applied thereto during pivotal displacement of said probe means for decreasing an effective inner diameter of said ring means and for increasing frictional engagement forces acting between said ring means and an arrow shaft upon which said ring means is slideably sleeved.

* * * * *